US008702539B2

(12) United States Patent
Sidley

(10) Patent No.: US 8,702,539 B2
(45) Date of Patent: Apr. 22, 2014

(54) PUSH-PASS TECHNIQUE AND SYSTEM FOR TRAINING SOCCER PLAYERS

(76) Inventor: Craig S. Sidley, White Plains, NY (US)

( * ) Notice: Subject to any disclaimer, the term of this patent is extended or adjusted under 35 U.S.C. 154(b) by 265 days.

(21) Appl. No.: 12/954,391

(22) Filed: Nov. 24, 2010

(65) Prior Publication Data

US 2011/0172034 A1 Jul. 14, 2011

Related U.S. Application Data

(60) Provisional application No. 61/293,819, filed on Jan. 11, 2010.

(51) Int. Cl.
*A63B 69/00* (2006.01)

(52) U.S. Cl.
USPC ..... 473/446; 482/79

(58) Field of Classification Search
USPC ..... 473/446; 482/66, 70, 79, 80, 146
See application file for complete search history.

(56) References Cited

U.S. PATENT DOCUMENTS

| | | | | |
|---|---|---|---|---|
| 4,506,884 | A * | 3/1985 | Hankin | 482/131 |
| 5,232,423 | A * | 8/1993 | Hajduczek | 482/68 |
| 5,620,186 | A | 4/1997 | Dudley | |
| 5,833,584 | A * | 11/1998 | Piaget et al. | 482/70 |
| 6,280,366 | B1 * | 8/2001 | Hsieh | 482/130 |
| 6,514,180 | B1 * | 2/2003 | Rawls | 482/70 |
| 7,066,846 | B2 | 6/2006 | Horkan | |
| D589,573 | S * | 3/2009 | McVay et al. | D21/668 |
| 7,601,107 | B2 * | 10/2009 | Maloy et al. | 482/123 |
| 7,846,073 | B2 * | 12/2010 | Summers | 482/70 |
| 7,892,152 | B1 * | 2/2011 | Teng | 482/79 |
| 7,935,032 | B1 * | 5/2011 | Jackson | 482/70 |
| 7,955,240 | B2 * | 6/2011 | Nadim | 482/146 |
| 2004/0053752 | A1 * | 3/2004 | Yang | 482/70 |
| 2004/0242381 | A1 * | 12/2004 | Parmater | 482/71 |
| 2009/0176631 | A1 * | 7/2009 | Blessing | 482/71 |
| 2011/0021325 | A1 * | 1/2011 | Summers | 482/70 |

* cited by examiner

*Primary Examiner* — Mark Graham
(74) *Attorney, Agent, or Firm* — Glen M. Diehl

(57) ABSTRACT

A push-pass technique system and method in accordance with the present invention for training soccer players having a frame along which is a track, that is formed into a semi-circle, raised on each end by graduating ramp, upon which slides a foot pedal that can be secured by four wheels on each side to the track and the frame. The foot pedal glides back and forth upon the horizontal plane and moves length-wise across the plane to a pre-determined length following the curvature of the ramp. The foot pedal will guide the player's foot into the proper horizontal position while training the player to execute the proper push-pass soccer technique and gain muscle memory.

15 Claims, 12 Drawing Sheets

PUSH-PASS TECHNIQUE AND SYSTEM FOR TRAINING SOCCER PLAYERS

CROSS-REFERENCE TO RELATED APPLICATIONS

This application claims the benefit of U.S. Provisional Application No. 61/293,819, filed Jan. 11, 2010, which is incorporated herein by reference.

BACKGROUND

Field of Invention

This invention related to a push-pass technique system for training soccer players.

Soccer is a major global professional and recreational sport. Soccer is played by more than 120 million regular players and countless others on beaches, playgrounds and streets, according to a 2006 National Geographic study.

In the local youth soccer leagues, training sessions usually take place at a local school or park, where there may be limited time and training space. To make full use of the space and time (approximately 60 minutes per session) a soccer coach must carefully plan the training drills within the allotted time.

At the youth level, the soccer coach has the responsibility to teach players the basic skills required to become a good soccer player. One of the main skills for a soccer player to develop is the push-pass technique, which must produce both accurate and powerful passes and shots. Drills to perfect this skill require lots of repetitive practice. At the early stage of a player's development, a coach will usually feed a ball to the player who would then pass or push the ball to another player or back to the coach. The idea is for the young player to develop the art of making correct contact with the ball while executing the correct motions, and also to understand how and where to contact the ball in order to produce an accurate push-pass to another player.

During soccer training sessions, it is not unusual for precious training time to be wasted. Wasted training time can be caused by a number of reasons, for example, retrieving stray balls that have been kicked beyond the boundaries of the practice area, players having to stand in line to wait their turn to perform drills such as passing drills and push-passing drills.

In order to provide players and coaches greater control and feedback during their practice sessions and more effectively utilize the limited field and training time, new training devices and methods are needed. There are presently no known push-pass drill technique machines that the inventor is aware of at this time.

The present invention is directed to overcome the problems encountered during soccer training sessions.

SUMMARY

Method and apparatus to train soccer players to properly execute a push-pass are provided. In accordance with one embodiment, a soccer push-pass training system comprises a foot pedal on a track, moving the foot in a horizontal and semi-circular method to simulate proper push-pass technique and increase muscle memory.

In accordance with one aspect of the present invention, an apparatus to train a soccer player having a first leg with a first foot and a second leg with a second foot in a push-pass technique for training soccer players is provided. The apparatus includes a frame, a first track mounted on top of the frame, the first track having a curved shape and a sliding foot pedal. The sliding foot pedal moves on the first track across the frame and is enabled to receive the first foot. While the foot pedal can be positioned relative to the track in many different positions, a position at an angle not greater than substantially perpendicular to the track is preferred. The sliding foot pedal is movably attached to the first track enabling the player to move the sliding foot pedal from a first end of the first track to a second end of the first track with the first leg.

In accordance with another aspect of the present invention, the sliding foot pedal can have wheels that turn along the frame when the sliding foot pedal is moved along the first track.

A second track mounted on top of the frame can also be provided in accordance with a further aspect of the present invention. The sliding foot pedal is movably attached to the second track enabling the player to move the sliding foot pedal from a first end of the second track to a second end of the second track.

In accordance with a further aspect of the present invention, the first and second tracks are shaped so that the soccer player moves the first leg in a pendulum like movement.

A position member that indicates a preferred position of the second foot can also be optionally provided.

In accordance with another aspect of the present invention, the first track is substantially symmetrical about a lowest height. When the second track is provided, it is preferably shaped the same way as the first track.

In accordance with a further aspect of the present invention, when the sliding foot pedal is at a lowest height on the curved track, the distance from the sliding foot pedal to the ground that is not greater than a diameter of a soccer ball.

In accordance with one aspect of the present invention, the foot pedal is foot shaped. The frame can be a tubular frame. The frame can be easily disassembled and reassembled.

The training apparatus is, in accordance with an aspect of the present invention, part of a training kit that includes a training video. The training video provides instruction as to the proper push-pass technique.

The present invention also provides a method of training a soccer player. In accordance with one aspect of the method of the present invention, a soccer player places a first foot in a foot pedal, the foot pedal being movable attached to a track and being oriented such that it is approximately perpendicular to the track. Then the soccer player moves a leg to move the foot pedal in the track so that the foot travels through a curved motion. The track is curved such that the leg moves with pendulum-like motion with the foot traveling along the curved track.

In accordance with another aspect of the present invention, the foot pedal is held in place in the track. The foot pedal can optionally have wheels that move along a frame that holds the track.

The soccer player can also optionally position a second foot in accordance with a position member that indicates a preferred position of the second foot.

DRAWINGS

The following drawings form part of the specifications and are included to further demonstrate certain aspects of various embodiments. The embodiments may be better understood by reference to one or more of these drawings in combination with the detailed description of specific embodiments and their operations.

Figure 6:
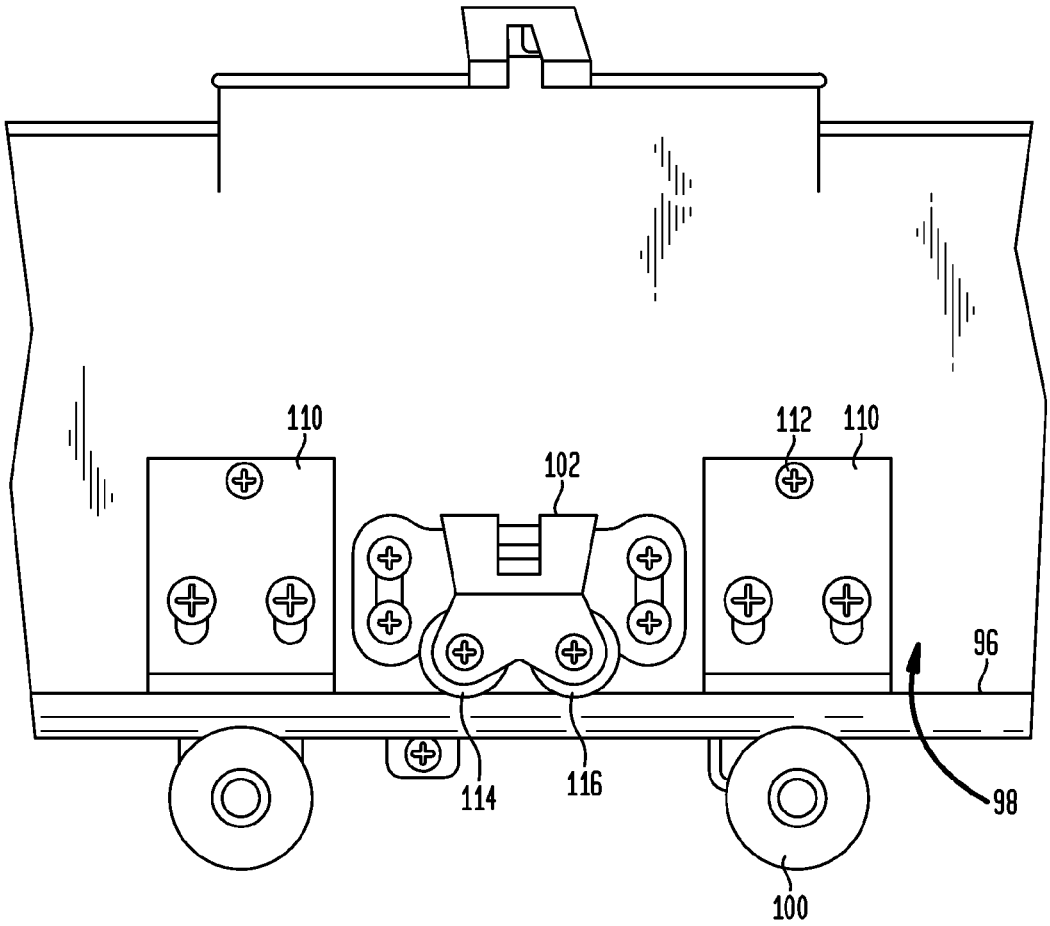
Figure 7:
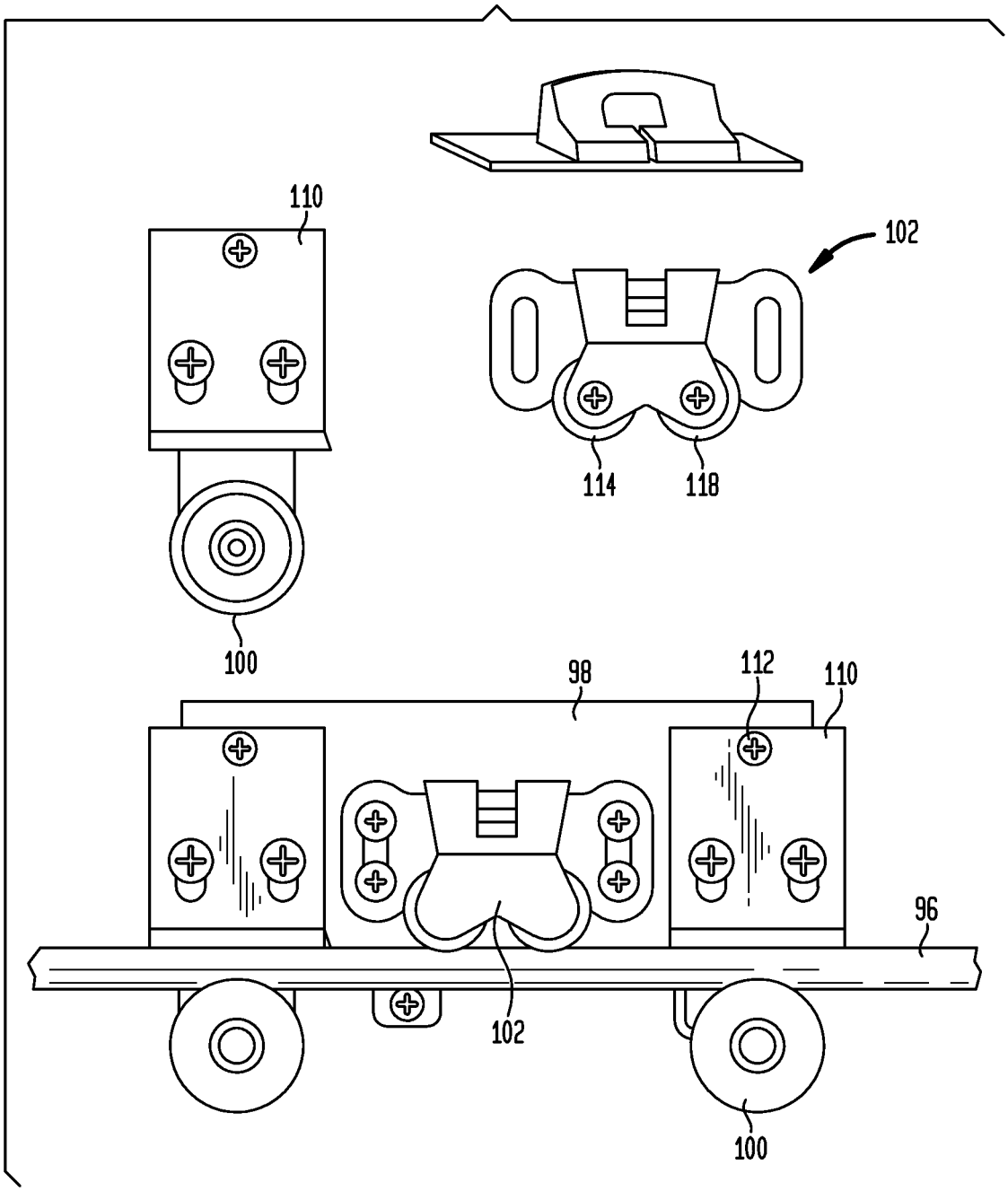

FIGS. 6 and 7 show side views of the roller board in accordance with an aspect of the present invention. As shown, the wheels 100 attached on the outer edges of the side roller board 98 will roll on the under side of the horizontal track 96. The wheels 102 attached in the center of the roller board 98 will roll above the horizontal track 96.

Figure 8:
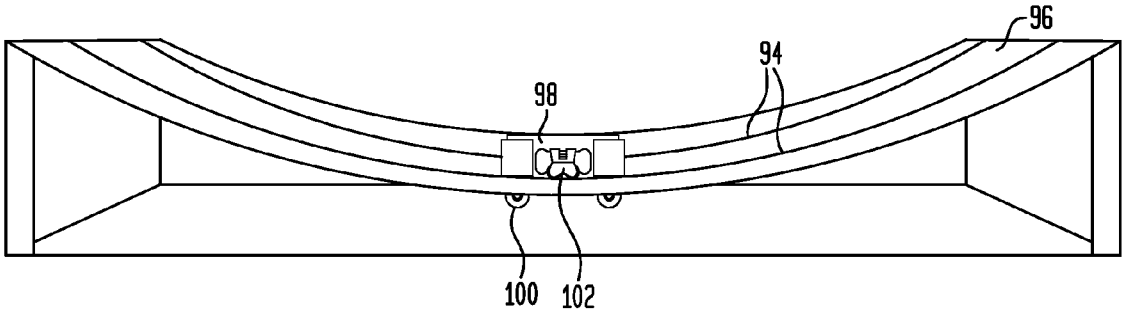

FIG. 8 shows a side view of the assembled training device in accordance with an aspect of the present invention.

Figure 9:
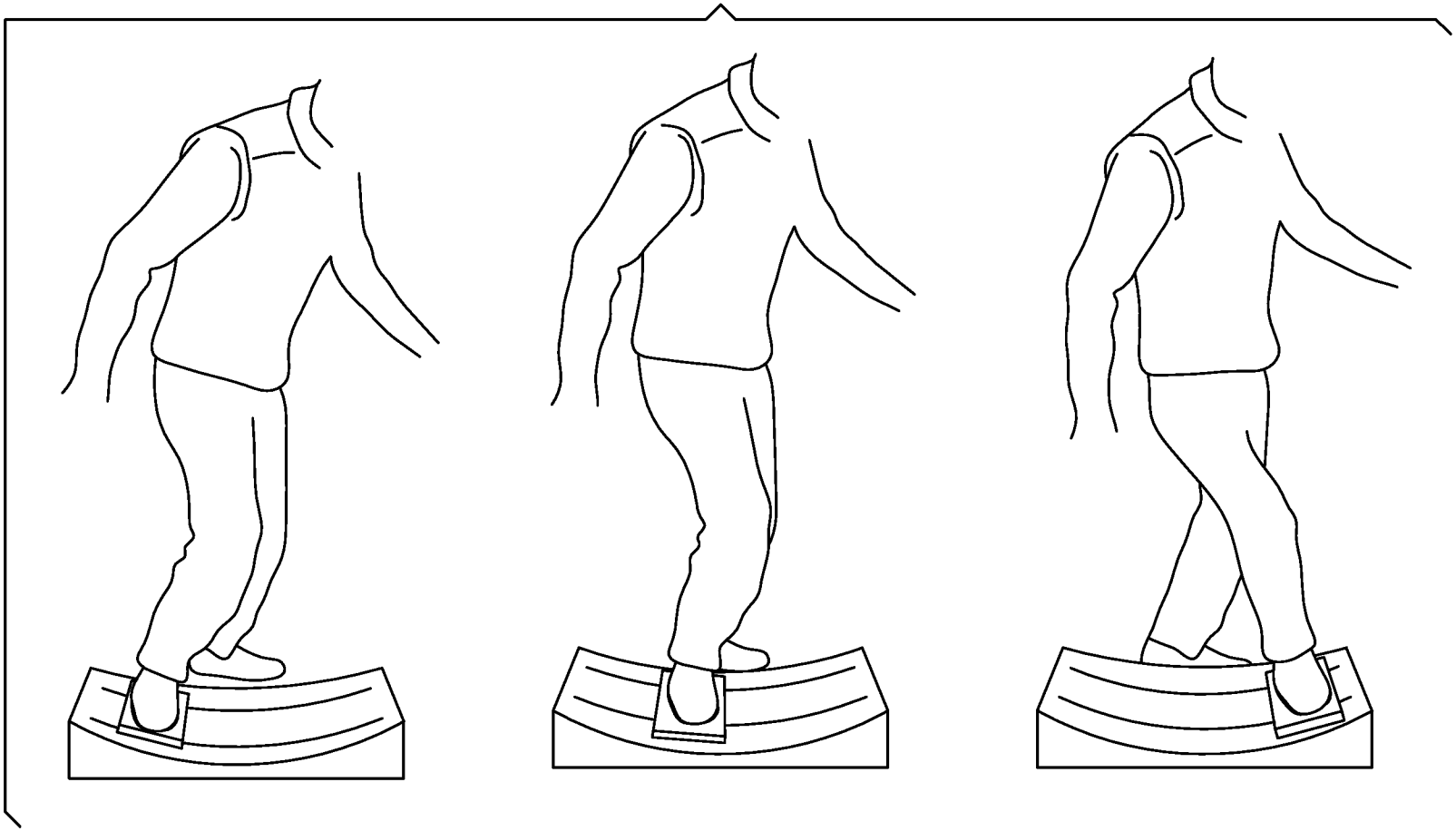

FIG. 9 shows the apparatus in accordance with an aspect of the present invention in usage.

Figure 10:
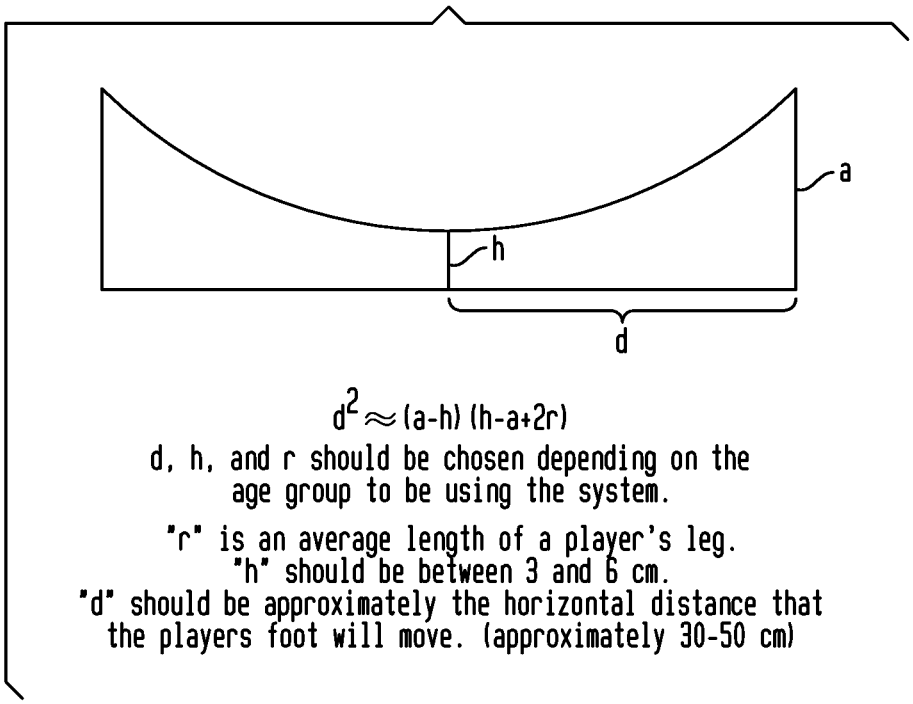

FIG. 10 illustrates one way to size the apparatus of the present invention in accordance with one aspect of the invention.

Figure 11:
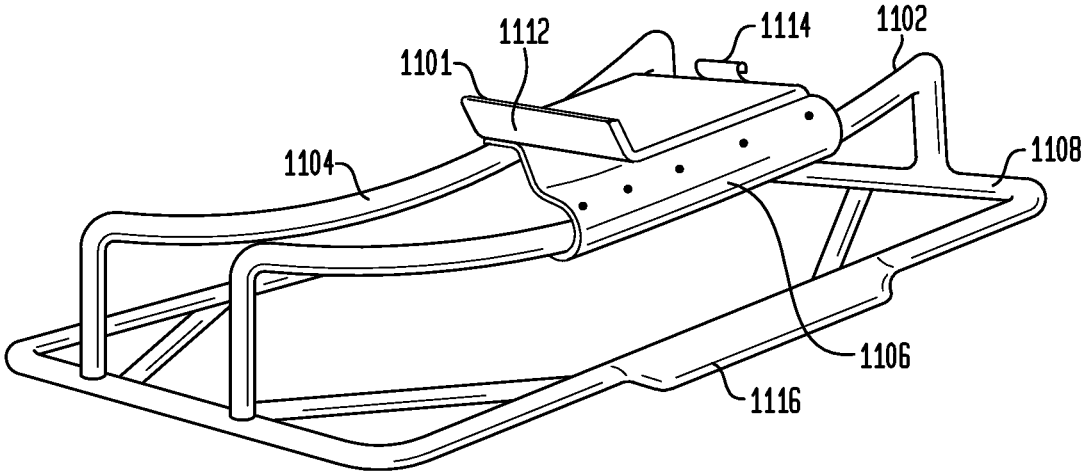
Figure 12:
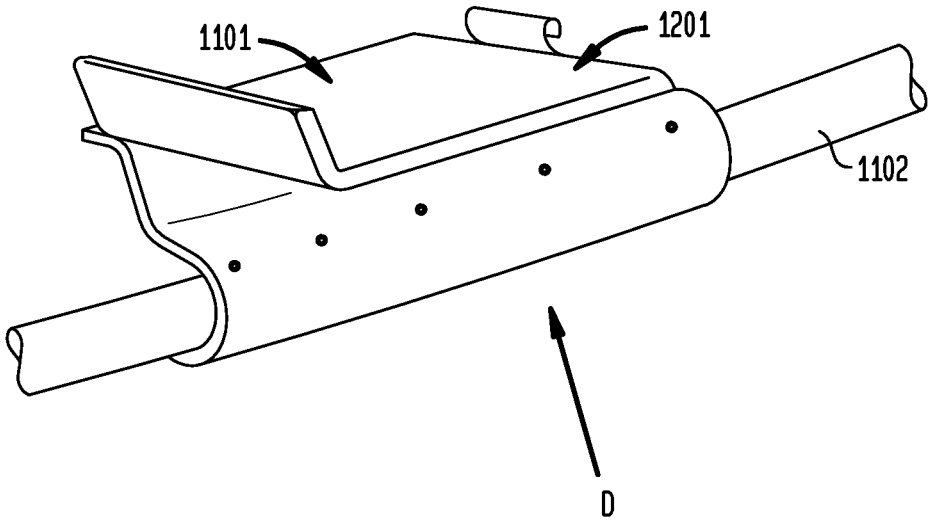

FIGS. 11 and 12 illustrate an embodiment of the training device using a tubular frame in accordance with an aspect of the present invention.

DETAILED DESCRIPTION

Figure 1:
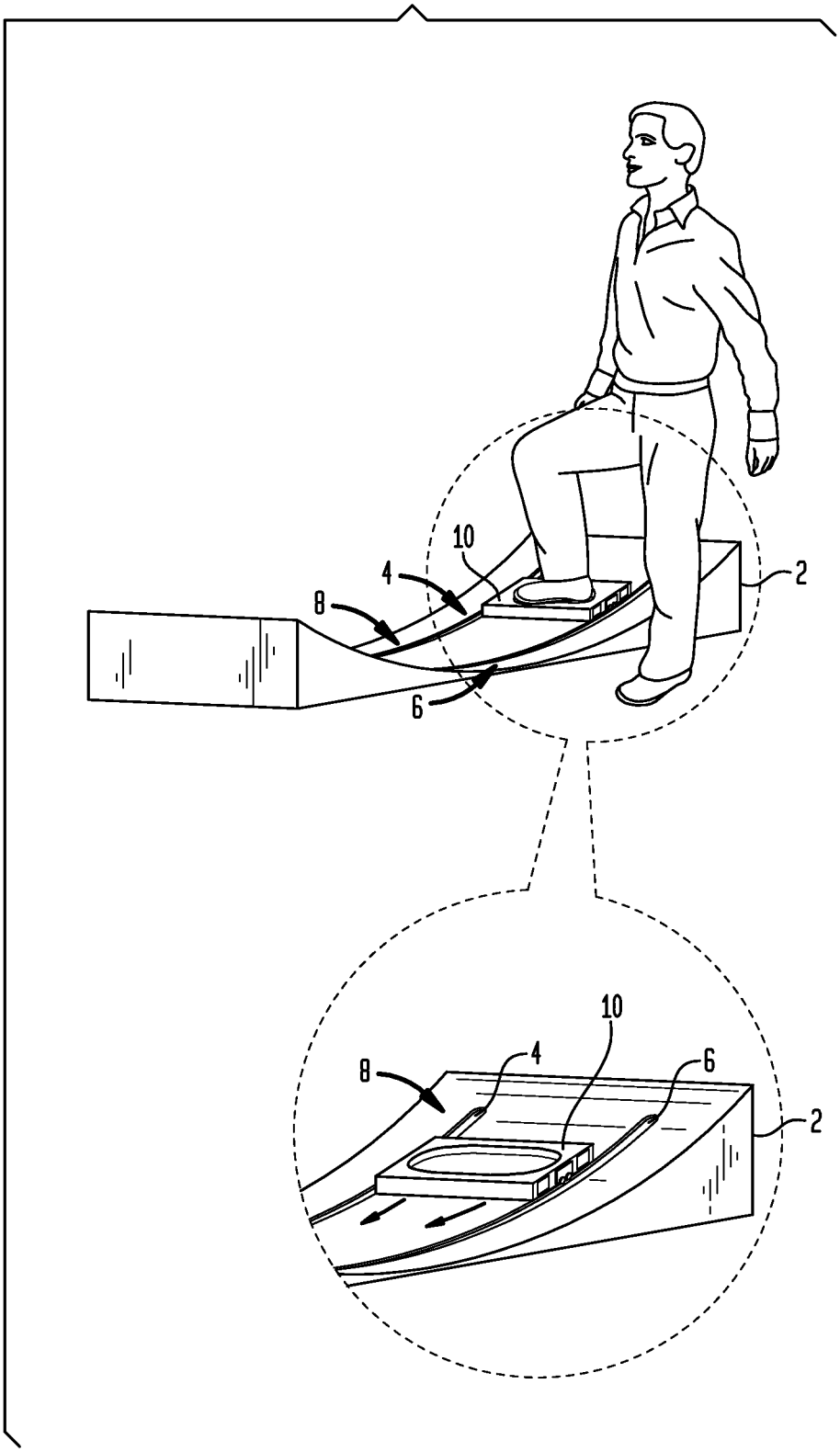
FIG. 1 shows a perspective view of one aspect of the push-pass technique systems of the present invention in usage with the foot pedal on the semi-circular horizontal track.

A push-pass training technique system in accordance with one aspect of the present invention is illustrated in FIG. 1. The system has a generally rectangular horizontal base 2 with one or more tracks 4 and 6 on top 8 of the frame 2. The track lies horizontally in the frame 2. The frame 2 is curved on top 8, and when a roller board 10 moves in the tracks 4 and 6, the roller board 10 moves in a curved motion. The curvature, for example, can approximately trace out the arc of a pendulum. FIG. 10 shows a mathematical relationship for the best dimensions of the system so that the curvature traces out the arc of a pendulum and wherein 'r' represents the length of a players leg, 'd' represents half the length of the base, 'a' represents the height at the ends of the system, and 'h' represents the height in the middle. According to that relationship, $d^2$ is approximately $(a-h)(h-a+2r)$. The variables d, h and r typically depend on a player's age. R is the average length of a player's leg. The variable h is typically between 3 cm and 6 cm. The variable d is approximately the horizontal distance that a player's foot will move, usually between 30 cm and 50 cm.

In accordance with an embodiment of the present invention, the curved frame is symmetrical about its lowest point in the middle. This means that the length and curvature of the frame moving a foot forward for a player using the device facing in a certain direction is the same or substantially the same as the length and curvature as moving the foot backward for the player facing the same direction. One consequence of a symmetrical frame is that the device can be used by a player facing in either direction, if the sliding board accommodates this. In a further embodiment of the present invention the curvature of the frame on one side of the device is different from the curvature at the other side. In such an embodiment of the training device a player can train for types of push passes by facing different directions. Or the device can be used by persons of different heights.

In accordance with one aspect of the present invention, the roller board 10 is firmly attached in a movable manner to the frame 2. The roller board 10 moves along the one or more tracks 4 and 6 in a horizontal motion back and forth along the track using fixed wheels in one aspect of the invention.

Figure 2:
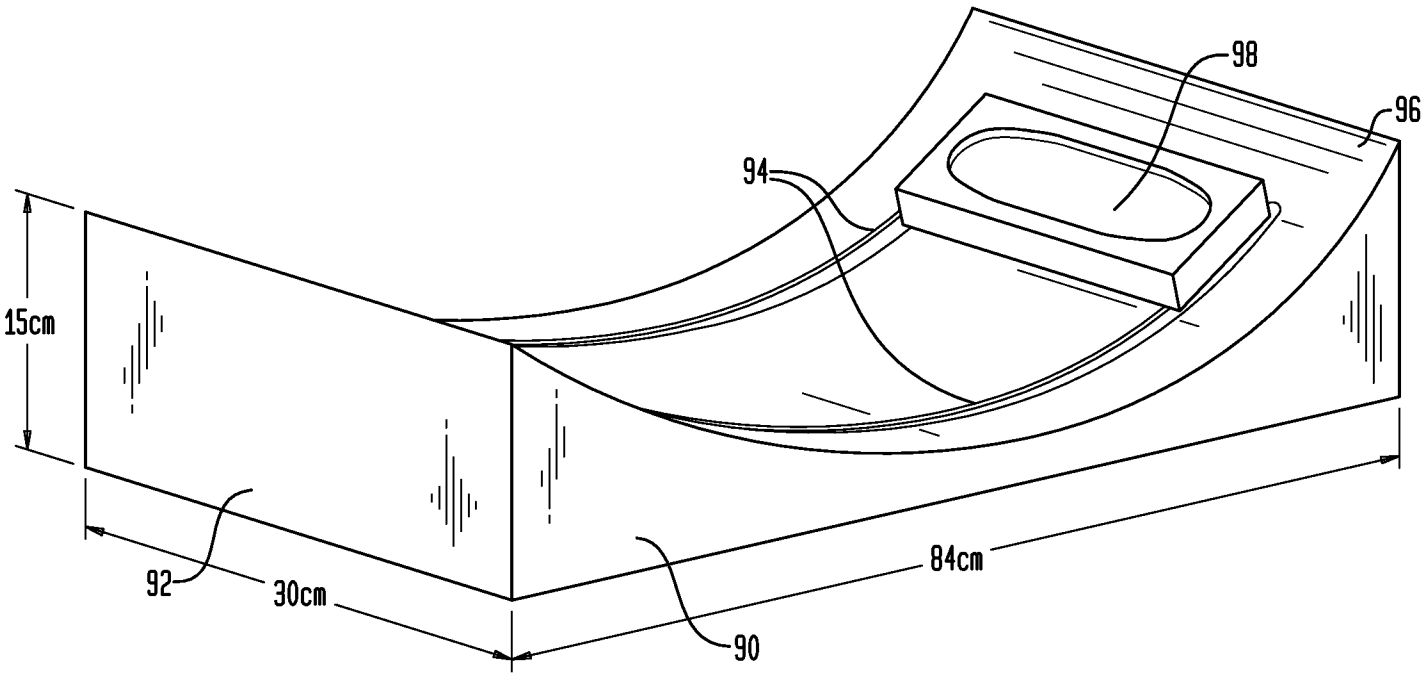
FIG. 2 shows a front view of one aspect of the push-pass technique system with the foot pedal attached to the horizontal track.

FIG. 2 shows the system without a player to reveal the actual layout and design of the machine in accordance with one aspect of the present invention. There are two tracks 94, each having a slit, shown in the base 96. The base 96, in accordance with one aspect of the invention, has a length of 84 cm, a width of 30 cm and a height at the end of 15 cm. The height in the middle is less than 15 cm and can be 3 to 6 cm depending on the age of the soccer player. All of the dimensions can vary in accordance with the age and size of the player being trained. The base 96 can also be referred to as a frame.

In one embodiment of the present invention, the height of the position of the pushing foot of the player on the sliding foot pedal is not higher above the position of the static foot than the diameter of a soccer ball. In a further embodiment, the position of the pushing foot of the player on the sliding foot pedal is not higher than the knee of the static leg of the player. In yet a further embodiment of the present invention, the position of the foot of the player on the sliding foot pedal is between half the diameter of a soccer ball above the static foot of the player and lower than or equal to the position of the knee of the static leg of the player.

Figure 3:
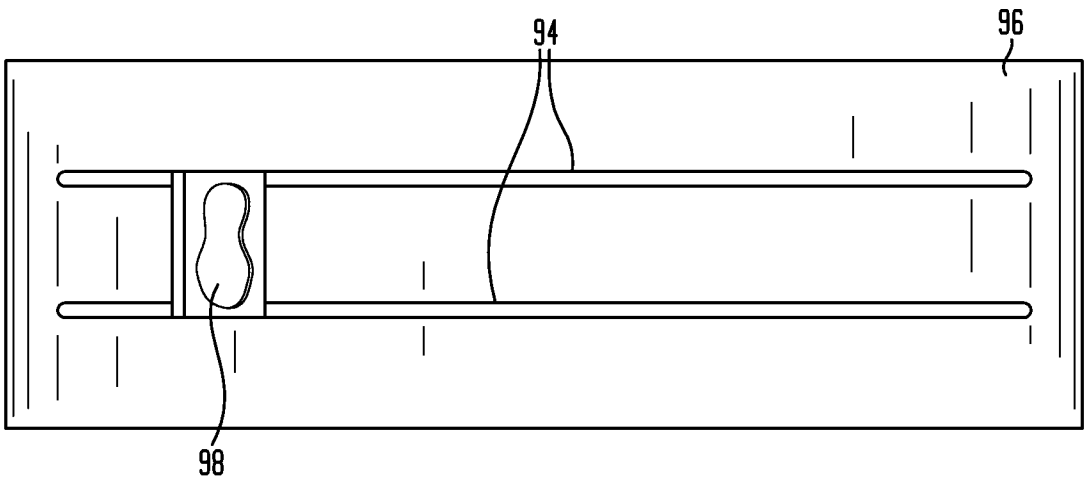
FIG. 3 shows an aerial view of one aspect of the push-pass technique system with the horizontal track and roller board attached to the track.

FIG. 3 consists of an aerial view of one aspect of the system, showing that the tracks 94 run along the length of the system in a horizontal manner, in a length that is several inches shorter than the length of the base. It also shows that the foot pedal 98 has an indented area that is shaped like a foot. Other shapes can also be provided. By providing a more general shape, a player could fit both left and right feet into the foot pedal 98 to train both legs in the push-pass technique.

Figure 4:
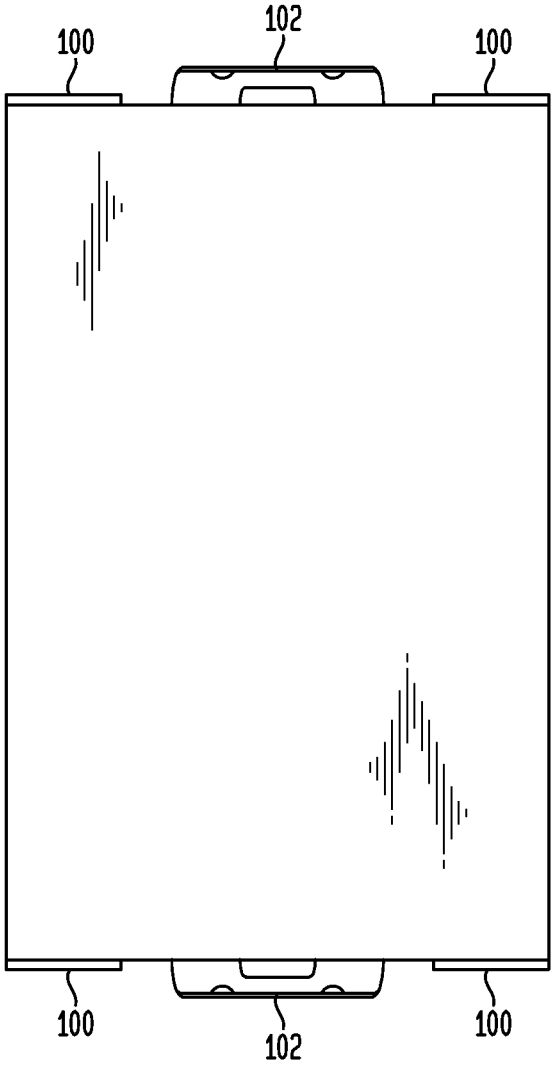
FIG. 4 shows a top view of a roller board in accordance with an aspect of the present invention.
Figure 5:
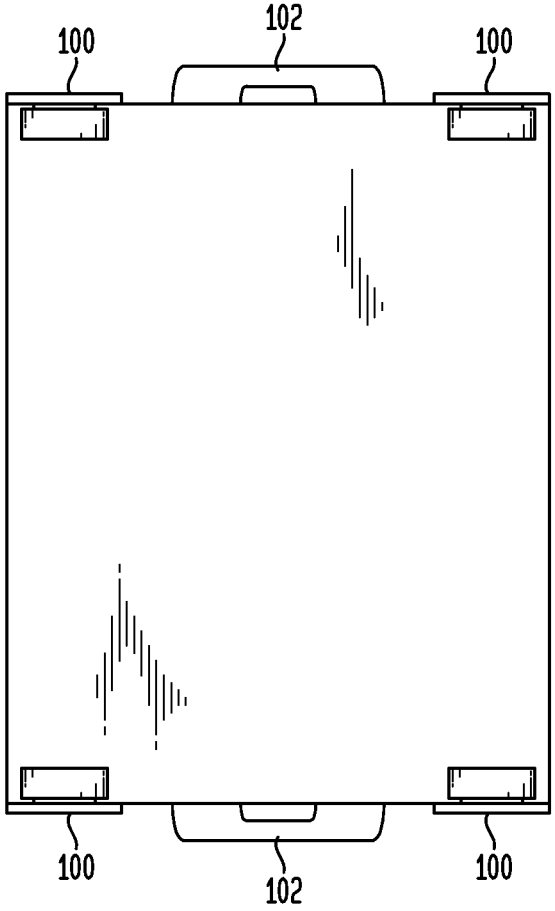
FIG. 5 shows a bottom view of the roller board in accordance with an aspect of the present invention.

FIG. 4 shows a top view of a roller board in accordance with an aspect of the present invention. The foot pedal 40 preferably has four wheels 100 and two center mounts 102. An impression for a foot (not shown) can be provided in the top of the roller board. FIG. 5 shows a bottom view of the roller board in accordance with an aspect of the present invention.

FIGS. 6 and 7 show side views of the roller board in accordance with an aspect of the present invention. As shown, the wheels 100 are attached on the outer edges of the side of the roller board 98 with brackets 110 by bolts or screws 112. The wheels contact the underside of the horizontal track 96 in the frame and freely rotate to allow the foot pedal to move in the tracks 96. The center mount 102 has two wheels 114 and 116 which extend downward from the foot pedal to contact the top of the frame. The wheels 100 prevent the foot pedal from moving up off the frame and the wheel 114 and 116 keep the foot pedal in contact with the frame 2. The wheels 102 attached in the center of the roller board 98 freely roll above the horizontal track 96.

FIG. 8 shows a side view of the assembled training device in accordance with an aspect of the present invention. FIG. 9 shows the apparatus in accordance with an aspect of the present invention in usage.

As shown in FIG. 1, the roller board is held onto the track by the use of wheels, two wheels being on the outside of the roller board and two wheels being on the inside of pedal and generally not immediately visible to the naked eye.

The base, roller board and wheels can be made using heavy duty plastic or any other synthetic material suitable for this system.

Operation

The manner of using the push-pass system is similar to a player passing the ball using his/her own muscle and leg strength. The system, however, will guide the player's muscles to mimic proper passing technique needed to move the ball from player to player in the appropriate manner. The player will stand next to the machine, intersecting the machine at a right angle. The player will place his or her foot on the roller board, moving his or her foot along the track back and forth along the whole of the track in a horizontal motion, from end to end, thereby mimicking proper push-pass techniques and creating muscle memory each time the machine is utilized. See FIG. 9. The ankle of the players passing foot should remain locked while the motion is being performed. To help facilitate this, the toes should be curled up and the shin muscle should be flexed. The knees of the player should be bent slightly in order to make the player more stable and perform the motion correctly. FIG. 9 shows a player performing the motion using his right foot to pass and his left foot to remain stationary. The stationary foot is on the ground, flush to the push-pass system, parallel to the motion direction and approximately placed in the center of the system. This is done without a ball being kicked. After the player repeats this motion, the player then practices the motion by kicking a ball with another player. It is believed that a player should repeat the passing motion on the training device 100 to 500 times every practice session and then practice passing with a ball with another player multiple times. Preferably, practice sessions occur two to four times a week.

It is a primary objective of this embodiment to provide a push-pass technique training system that may rapidly increase a player's passing skills by providing information as to how the player should stand and position him/herself while passing the ball, in relation to the ball, and to stimulate proper movement and muscle memory in the legs so that the player may utilize these correct muscles and techniques perfectly each and every time s/he passes the ball in a game or practice situation.

Advantages

From the descriptions above, a number of advantages of the push-pass technique system become evident: The player will gain muscle memory as to the proper technique as to how to pass the ball in a proper manner and how to position one's body when doing so. The portable push-pass technique system can be set up on the field in seconds flat. Soccer players can train on the machines and not waste valuable training time waiting in line for drills. Soccer players can also use the machine at home as a way to train and learn proper techniques on their own time either inside the home or outside the home.

Conclusion and Ramifications

The embodiment of the push-pass technique system provides a versatile, effective and productive soccer training system that can be used by coaches or individual players on soccer fields, parks, indoors or in backyards. The apparatus of the present invention could also be made with a single track. Further the foot pedal could be guided in the track with simple pegs that extend downward from the foot pedal into the track. Various other alterations to the apparatus can be made while still remaining within the scope of the invention.

While the above descriptions contain specific embodiments of the present invention, these should not be construed as limitations on the scope of the invention.

Variations

Although the above described device has two tracks, the device may be built with one or more tracks provided the roller board is only able to move in the above description. The tracks may be made of any lightweight durable material and the wheels or pegs guiding the roller board may be parallel or perpendicular to the track as long as the desired motion is achieved. In accordance with one aspect of the invention, it is preferred that the board not be able to have a rotational pivot as this could cause the player(s) to develop bad technique habits. The roller board may have a foot pedal attached and this foot pedal may have adjustable clamps in order to secure the users foot so it cannot slide of the board during use. If there is no foot pedal for the user, the user should be sure to keep his foot perpendicular to the direction of motion.

In a further embodiment of the present invention the foot of the user on the board is in a pre-determined angle in relation to the direction of the motion of the leg of the foot. In a preferred embodiment the angle of the foot in relation to the motion of the leg is at an angle of 90 degrees. The foot in a further embodiment of the present invention can also be at a smaller angle in relation to the motion of the leg. A pedal on the board or the entire board, in one embodiment of the present invention, is rotatable in a fixable manner, so that a preferred angle of the foot can be implemented for exercise. This is helpful in situations wherein a player, for instance because of an injury, is not able to turn the foot initially to a complete 90 degrees angle, but still would like to exercise the leg. The board or pedal in one embodiment of the present invention are rotatable to a fixed position, wherein the foot can be placed on the board or pedal at a fixed angle in relation to the movement of the leg that is greater than parallel to the moving direction and not greater than 90 degrees. In yet a further embodiment of the present invention the angle of the foot on the board is equal or greater than 30 degrees in relation to the movement of the leg.

The foot on the ground (the plant foot) should be parallel lengthwise to the device and should be placed flush to the side of the device and as close the center as possible. For more advanced players, the plant foot may be adjusted in any variation so the motion can be practiced for more than the fundamental perpendicular placement. In one aspect of the present invention, the plant foot can be placed adjacent the frame of the In one embodiment of the present invention the foot board has a foot pedal that has a shape conforming to the size or the shape of the user of the board. In a further embodiment the foot pedal is separate from the board and can easily be detached from and attached to the board. For instance the board has a cut-out of a specific shape wherein a foot pedal or a board containing the foot pedal fits snugly so that the foot pedal does not move relatively to the board. The board in a further embodiment is provided with fasteners such as rotatable clips that hold the foot pedal or a board containing the foot pedal tightly fixed to the board when put in place. Such a replaceable foot pedal has several advantages. One can provide a foot pedal with the correct position with relation to the frame, thus providing the correct training position of the push-pass foot. Furthermore, one can provide a size of a pedal that is appropriate to a foot size of a player that is being trained. Furthermore, it is contemplated that the training device will be used in an inside training facility, wherein players preferably face in one direction, for instance to watch t.v. or a trainer. To prevent a player using the training frame from having to turn away from the facing direction when training the alternate leg a rotatable pedal on a board allows to rotate or to change a pedal to match the preferred facing direction.

As was discussed above, it is important for a player to be trained to apply a correct position when performing and learning the push-pass technique. This includes a correct position of the non-playing foot and leg. In one embodiment of the present invention the training device has an outside pedal or an outline board or other positioning members. These members can be in a shape of a foot or a shaped board for instance with a cut-out enabled to receive the non-pushing foot or static foot of the player. Alternately, they can be a simple tube extending from the frame. These members can be used to position the second foot of the player being trained, and may be called a position member. This position member can be fixed to the training device and either indicates the correct position of the non-playing static foot or holds the non-playing foot relatively difficult to move in the correct training position. In yet a further embodiment, such a position member for the non-playing foot is attached to the device in a movable way which includes at least setting a distance from the device and that can be fixed in a preferred position. In a further embodiment, the pedal or outline board or shaped board can be moved and fixed at a preferred angle to the training device.

In FIG. 11, the entire frame is built using tubular structures. They can be made of synthetics, metals, or any material durable enough to withstand the pressure of an athlete standing on the device. For example, it may be desirable for the apparatus of the present invention to withstand pressures up to 200 lbs. The foot pedal/foot sled 1101 is attached to the rail 1102. The foot sled 1101 can be attached to the rail 1102 by any feasible method that allows for relatively frictionless movement on the rails. The device can be constructed using one or more rails 1102 and 1104. The foot sled 1101 can be attached to the rail by linear bearings. Alternatively, the section 1106 can be formed so that the sled 1101 snaps onto the rail. In this case, the sled 1101 can be made of a plastic material that can accommodate being snapped onto the rail.

The functionality of the device should be preserved regardless of the mode of construction. This functionality is the placement of the feet and must be perpendicular or about perpendicular to each other and the foot on the sled must be able to slide in a circular arc or curved arc type manner in the direction that the foot on the ground is pointed.

The foot pedal/sled 1101 may be adjustable as to accommodate any foot size. The device may be made with a removable foot pedal/sled so as to add or remove difference sizes. The sled 1101 has an area 1110 that receives a foot. The foot, once placed in the area 1110, is surrounded by support ridges 1112 and 1114. When a player moves his foot, pressure is exerted against the ridges 1112 and 1114 so that the sled 1110 moves along the rail 1102.

The rails 1102 and 1104 are supported on a frame of tubular structures 1108. In one embodiment of the present invention, the tubes can forming the frame 1108 and the rails 1102 and 1104 can be easily assembled and disassembled. In this embodiment, the tubes are snap fit together to allow easy assembly and disassembly. A bag or other container can also be provided to carry the apparatus of the present invention.

Figure 11A:
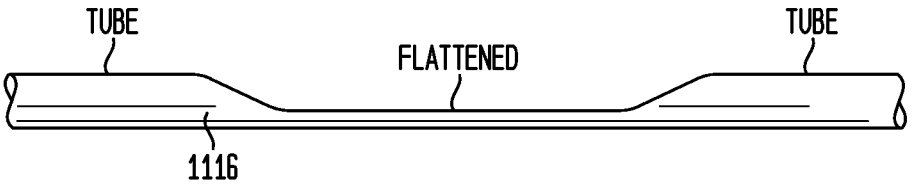

FIG. 11A illustrates a further aspect of the present invention. The area 1116 can be flattened, as shown. The flattened area protrudes out from the side of the apparatus shown in FIG. 11. This flattened area provides a space for the player being trained to place his or her planting foot so that the player can be properly trained. The planting foot should be placed so that it is essentially parallel to the apparatus shown in FIG. 11.

Figure 12A:
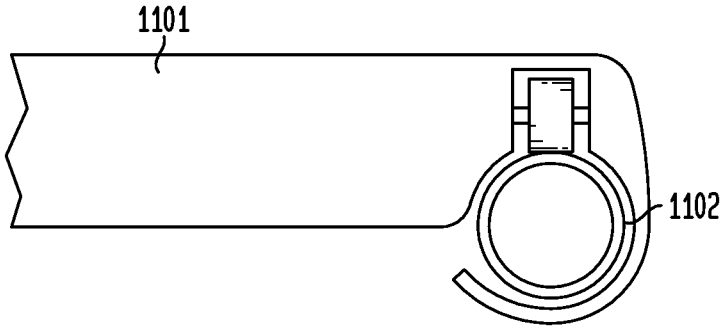

FIG. 12 shows one embodiment of a foot pedal/sled 1101. The sled 1101 may have an adjustable plate 1201 may be spring loaded as to clamp snuggly to the foot on the sled. FIG. 12A illustrates the sled 1101 being snap fit onto the rail 1102. In accordance with an aspect of the present invention, the sleeve 1200 is formed of plastic that can stretch to be fit over the tube 1102, but then snaps back in place to retain the sled 1101 on the tube. This arrangement can be provided so that both sides of the sled 1101 are snapped onto the tubes 1102 and 1104 (FIG. 11). Alternatively, one of the sides of the sled 1101 is constructed as illustrated in FIG. 12A to fit on the rail 1102 and the other side of the sled 1101 simply rides on top of the rail 1104 as the player moves his or her foot.

In a further embodiment of the present invention the tube frame may be constructed of individual tube components that fit at male/female endings where a first tube ending receives a second tube ending. This allows the frame of the training device to be disassembled for storage and/or transportation and assembled or re-assembled for use.

In yet a further embodiment of the present invention the training device is provided as a kit, for instance a training kit. The kit contains at least the training device, which may be provided with the tube frame as provided above, and may also be provided in the kit in a disassembled form. The kit includes packaging, which may be a box which may have a picture of the device in assembled form. The kit also includes instructions for assembly of the device. In yet a further embodiment of the present invention the kit includes a manual for using the device for training In yet a further embodiment the kit contains an instruction video for using the device. Such a video may be included as a DVD or any other video signal carrier. The video may also be available on a web site that is available to a buyer or a user of the training device.

I claim:

1. An apparatus to train a soccer player having a first leg with a first foot and a second leg with a second foot in a push-pass technique for training soccer players consisting essentially of:

a frame;

a continuous first and second track on the frame, the first track having a curved shape and the first track having a middle height of three to six centimeters at a middle of the first track and having a first end height at a first end of the first track and a second end height at a second end of the first track greater than the middle height;

only one sliding foot pedal, being sized and formed to receive only one of the soccer player's feet, enabled to receive the foot in a position at an angle not greater than substantially perpendicular to the track and the sliding foot pedal being movably attached to the first track enabling the player to move the sliding foot pedal from the first end of the first track to the second end of the first track with only one leg, wherein the sliding foot pedal is configured to freely slide under a force applied by the foot; and a first and second moving means each separately attached to the sliding foot pedal and unconnected to each other, wherein said first moving means moves along the first track and said second moving means moves along the second track.

2. The apparatus of claim 1, wherein said first and second moving means are wheels that turn along the frame when the sliding foot pedal is moved along the first track.

3. The apparatus of claim 1, wherein the first and second tracks are shaped so that the soccer player moves the first leg in a pendulum like movement.

4. The apparatus of claim 1, further consisting essentially of a position member that indicates a preferred position of the second foot, such that the second foot contacts no other element of the apparatus.

5. The apparatus of claim 1, wherein the first track is substantially symmetrical about a lowest height.

6. The apparatus of claim 1, wherein the foot pedal is foot shaped.

7. The apparatus of claim 1, wherein the frame is a tubular frame.

8. The apparatus of claim 1, wherein the frame can be disassembled and reassembled.

9. The apparatus of claim 1, wherein the apparatus is part of a training kit that includes a training video.

10. The apparatus of claim 1, wherein the dimensions of the first track are in accordance with $d^2 \approx (a-h)(h-a+2r)$, where "r" is the length of the first leg, "a" is the first end height, "h" is the middle height, and "d" is a linear distance from the middle of the first track to the first end of the first track.

11. The apparatus of claim 10, wherein "d" is between thirty and fifty centimeters.

12. The apparatus of claim 1, further consisting essentially of a third moving means wherein said third moving means moves along a surface that is not a track.

13. An apparatus to train a soccer player having a first leg with a first foot and a second leg with a second foot in a push-pass technique for training soccer players consisting of:

a frame;

a continuous first and second track on the frame, the tracks having a curved shape and the tracks having a middle height of three to six centimeters at a middle of the tracks and having a first end height at a first end of the first track and a second end height at a second end of the first track greater than the middle height;

only one sliding foot pedal, being sized and formed to receive only one of the soccer player's feet, enabled to receive the foot in a position at an angle not greater than substantially perpendicular to the tracks and the sliding foot pedal being movably attached to the tracks enabling the player to move the sliding foot pedal from the first end of the first track to the second end of the first track with only one leg, wherein the sliding foot pedal is configured to freely slide under a force applied by foot; and a first set of two wheels and a second set of two wheels each separately attached to the sliding foot pedal and unconnected to each other, wherein the first set of wheels moves along the first track and the second set of wheels moves along the second track.

14. The apparatus of claim 13, wherein the first and second tracks are shaped so that the soccer player moves the first leg in a pendulum like movement.

15. The apparatus of claim 13, wherein the first track is substantially symmetrical about a lowest height.

* * * * *